United States Patent [19]

Nakakura

[11] 4,384,955

[45] May 24, 1983

[54] CHIPS-DEOILING MACHINE

[76] Inventor: Shinji Nakakura, c/o Toyo System Co., Ltd., 26-8, Hannancho 3-chome, Abenoku, Osaka, Japan

[21] Appl. No.: 210,348

[22] Filed: Nov. 25, 1980

[51] Int. Cl.[3] ..... B30B 9/18

[52] U.S. Cl. ..... 210/415; 210/350; 100/117; 100/150

[58] Field of Search ..... 210/350, 415, 488; 100/117, 145–150

[56] References Cited

U.S. PATENT DOCUMENTS

| | | | |
|---|---|---|---|
| 3,585,924 | 6/1971 | Nolan | 210/415 |
| 3,695,173 | 10/1972 | Cox | 210/415 |
| 3,919,087 | 11/1975 | Brumagim | 210/350 |
| 4,002,559 | 1/1977 | Paterson et al. | 210/415 |

FOREIGN PATENT DOCUMENTS

| | | | |
|---|---|---|---|
| 2347078 | 11/1977 | France | 210/415 |
| 47-1268 | 1/1972 | Japan | 210/350 |

*Primary Examiner*—Benoît Castel

*Attorney, Agent, or Firm*—Oblon, Fisher, Spivak, McClelland & Maier

[57] ABSTRACT

A chips-deoiling machine, which is characterized in that a group of separators consisting of a number of single separators being spaced controllably in equal intervals in relation to the neighboring separators, which group of separators is provided within a carrying passage through which chips thrown into a chips-charging port are carried toward a chips-discharging port with the aid of the rotation of a screw shaft, and that the cutting oil contained in said chips is separated through the respective gaps between said single separators in the process of said chips passing from one side of the interior of said group of separators toward the other side.

1 Claim, 6 Drawing Figures

CHIPS-DEOILING MACHINE

BACKGROUND OF THE INVENTION

1. Field of the Invention

The present invention relates to a chips-deoiling machine for separating cutting oil having been used at the time of the cutting from chips having generated while a workpiece had been cutted on a machine tool.

2. Description of the Prior Art

Such kinds of apparatus heretofore in use included for their fundamental part some centrifugal separator which was to separate cutting oil by centrifugal force from chips containing cutting oil therein which had been put into a high-speed rotating wire netting basket. Accordingly, in this case, the basket was easily worn out drastically, thus being poor in durability. Further, it presented a serious inconvenience that baskets different in mesh had to be exchanged for use each time chips of different size were deoiled. Also, these conventional apparatus did not always have a high deoiling efficiency because of their sometimes getting clogged by chips which have eaten into the mesh of the basket. On top of that, there were such drawbacks that power requirements were high because of high-speed rotation irrespective of a heavy load, accompanied by disagreable vibration and noise was accompanied therewith.

SUMMARY OF THE INVENTION

The present invention was contrived in view of the circumstances mentioned above. It contemplates the provision of a chips-deoiling machine which is simple in structure and consequently can be made at a low price on the basis of being constructed so as to be able to separate a cutting oil contained in chips while the chips are being conveyed by a screw shaft through a group consisting of many single separators arranged in a line spacing at regular intervals, while eliminating disadvantages of the prior art.

BRIEF DESCRIPTION OF THE DRAWINGS

One example of the present invention will now be described in detail with reference to the accompanying drawings, in which.

DESCRIPTION OF THE INVENTION IN RELATION TO THE DRAWINGS

Figure 1:
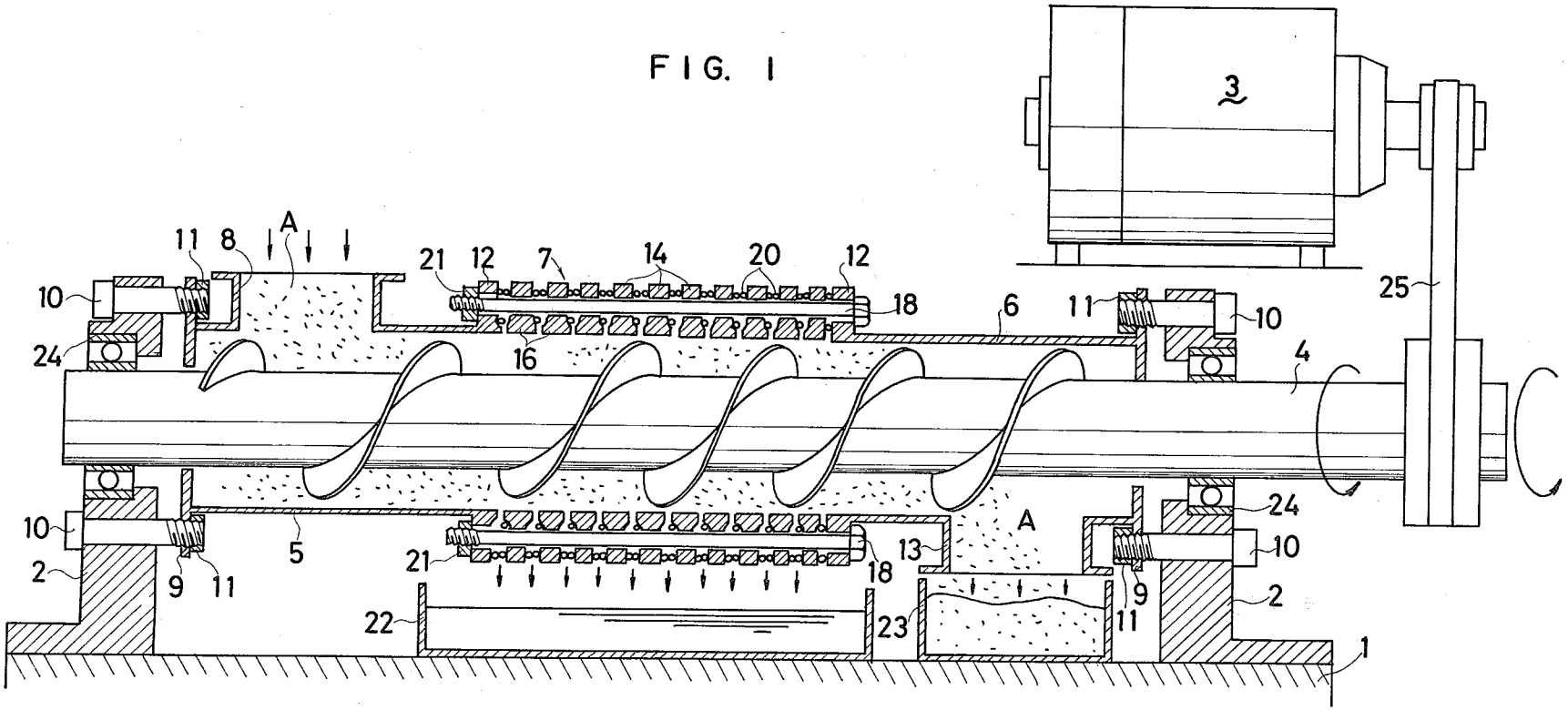
FIG. 1 is a longitudinal sectional view of an example of the present invention.
Figure 2:
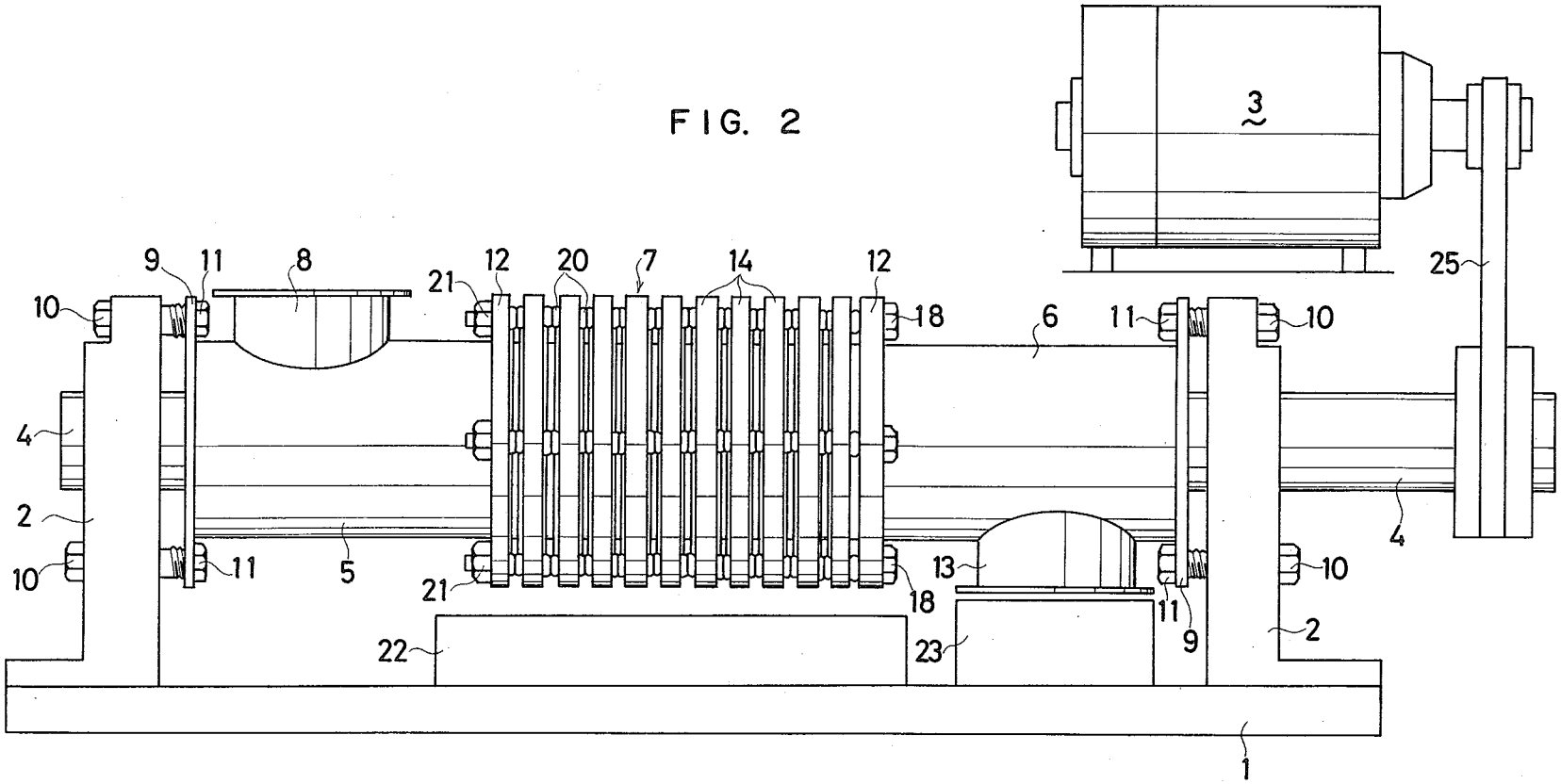
FIG. 2 is a side view thereof.
Figure 3A:
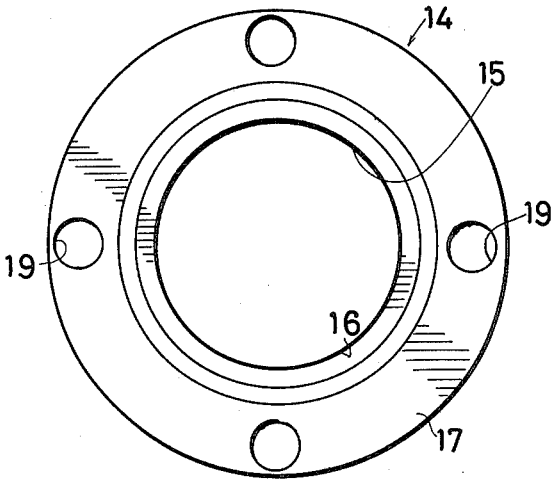
FIG. 3A is an elevational view of one embodiment of the separator of the invention.
Figure 3B:
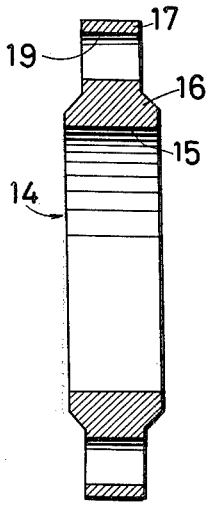
FIG. 3B is a sectional view of the embodiment shown in FIG. 3A.

As seen in the figures, the chips-deoiling machine according to the present invention is composed of a screw shaft 4 being rotatably connected to a prime mover 3 on two bearings 2, 2 fixedly secured on a bed 1, a charging-side cylinder 5 which is movably mounted to one side of the bed 1 and inside which one end part of the screw shaft 4 is placed, a discharging-side cylinder 6 which is movably mounted to the other side of the bed 1 and inside which the other end part of the screw shaft 4 is placed and a group of separators 7 the sides of which are supported respectively on the circumferential shells of the charging-side cylinder 5 and the discharging-side cylinder 6 and inside which the middle part of the screw shaft 4 is placed. A section of the upper surface of the charging-side cylinder 5 is open to form a chips-charging port 8. A fitting disc, 9 formed on the end of the cylinder 5 towards the side of the bearing 2 is fixed with the help of the bearing 2, a fitting bolt 10, and a fitting nut 11, so that the charging-side cylinder 5 may be made to draw close to the bearing 2 or to become distant therefrom by fastening or loosening the fitting nut 11. With the object of fixing fast the group of separators 7, a flanged part 12 is formed on the end of the charging-side cylinder 5, towards the side of the group of separators 7.

A section of the lower surface of the discharging-side cylinder 6 is open to form a chips-discharging port 13. A fitting disc formed on the end of the cylinder 6 to the side of the bearing 2 is fixed with the aid of the bearing 2, a fitting bolt 10, and a fitting nut 11, so that the discharging-side cylinder 6 may be made to draw close to the bearing 2 or to become distant therefrom by fastening or loosening the fitting nut 11. With the object of fixing fast the group of separators 7, a flanged part 12 is formed on the end of the discharging-side cylinder 6, towards the side of the group of separators 7.

The group of separators 7 consists of an assemblage of many single separators 14. Each separator 14 has in its interior a central hole 15 of a diameter equal to the inside diameter of the aforesaid cylinder 5 or 6. The circumferential region outwardly adjacent to the central hole 15 constitutes a thick boss part 16, outside which is further formed a peripheral part 17 thinner than the boss part 16. This peripheral part 17 is provided with connecting holes 19 which are used in cooperation with other similar holes of the same shape for the purpose that a connecting bolt 18 will pass therethrough in order to connect all of the separators 14. The boundary region between the boss part 16 and the peripheral part 17 may be made either tapered or stepped. The group of separators 7 is formed in a single unit by first interposing coiled springs 20 having same elastic resilience between the corresponding connecting holes 19 of as many single separators 14, respectively, then by making the connecting bolt 18 pierce through these connecting holes 19 and coiled springs 20, and lastly by fastening them all tightly together with the use of a connecting nut 21.

The mounting of the group of separators 7 of such a structure on both cylinders 5, 6 is made in such a manner that, after inserting the connecting bolt 18 into the hole formed at the flanged part 12 of the discharging-side cylinder 6, the same connecting bolt 18 is made to pierce through a chain of connecting holes 19 and coiled springs 20 stretching in a row, as mentioned above, and then the end of the connecting bolt 18 is inserted into a hole formed at the flanged part 12 of the charging-side cylinder 5, where it is tightly fastened with the use of the connecting nut 21. At this time, the coiled springs 20 lying between the single separators 14 expand or contract in response to the clamping degrees of the connecting nut 21, as a result of which the distance of a gap between the single separators 14 can be varied as occasion demands, and consequently there can be varied also the distance of the gap between the boss parts 16 formed on the circumferential region of the central holes 15 and being adjacent to one another. In this connection, the coiled springs 20 are accommodated in the gaps formed by the difference in thickness between the boss parts 16 and the peripheral parts 17 of the single separators 14 adjacent to one another, so that it is possible to contract the distance of the gap between the adjacent boss parts 16 to 0 (Zero).

In the figures, the reference numeral 22 indicates an oil tank disposed on the bed 1 just under the group of separators 7; the numeral 23 indicates a chips receptacle placed on the bed 1 under the discharging port 13; the numeral 24 indicates a ball bearing for the screw shaft 4; and the numeral 25 indicates a belt transmitting the turning force of the prime mover 3 to the screw shaft 4.

Description will now be directed to the performance of the present invention of such a construction as mentioned above.

To begin with the preparation for operating, in the case of separating cutting oil from rough-cut chips A, the connecting nut 21 of each connecting bolt 18 is loosened to widen the distance of the gap between the separators 14 by the elastic resilient force of the coiled springs 20. At this time, the length of the group of separators 7 becomes longer to push the cylinders 5, 6 away in the direction of their own bearings 2, 2, leaving gaps produced between the fitting piece (disc) 9, 9 and the fitting nuts 11, 11. Therefore, filling up these gaps by clamping the fitting nuts 11, 11, the cylinders 5, 6 must be performed.

Conversely, in the case of separating cutting oil from fine-cut chips A, after the fitting nuts 11 have been first loosened, the connecting nuts 21 of all connecting bolts 18 are then tightened to narrow the distance of every gap between the single separtors 14 against the elastic resilient force of the coiled spring 20. At this time, the length of the group of separators 7 becomes shorter and the cylinders 5, 6 each shift in the direction of parting from the respective bearings 2, 2, when these cylinders are tightly fixed thereat by clamping the respective fitting nuts 11, 11.

Thus, the distance of every gap between the separators 14 can be regulated, in such a way as mentioned above, so as to be equal to one another only by tightening or loosening the connecting nuts 21 because the coiled springs 20 used are all equal in elastic resilience.

Now, chips A containing cutting oil generated in cutting a workpiece on a machine tool are thrown into the charging-side cylinder 5 through the chips-charging port 8. In the cylinder 5, inside which the screw shaft 4 is rotated by the prime mover 3 with the belt 25 between, the chips A thrown thereinto are conveyed in the direction of the group of separators 7 with the revolution of the screw shaft 4. At this time, the chips A are carried while being rotated and stirred along the inner walls of the central cavities of both charging-side cylinder 5 and group of separators 7, so that the cutting oil contained in the chips A leaks out of minute gaps formed by the boss parts 16 between the neighboring separators 14, and is collected in the oil tank 22 provided beneath the group of separators 7. On the other hand, the chips A, which have been isolated from the cutting oil which has passing through the group of separators 7, are further carried forward by the revolution of the screw shaft 4 to be pushed toward the discharging-side cylinder 6, and fall into the chips receptacle 23 where they are collected and accumulated.

In the foregoing example, description was made exclusively referring to the case where the distance of the gap between the single separators 14 was to be regulated by inserting the coiled springs 20 between the neighboring separators 14. However, given the capacity of a spacer to take the place of such an elastic body as the coiled springs 20 used here, or a plate spring and the like, it is permissible to interpose some kind of washer, on the condition that in case of changing the distance of the gap between the separators 14, one washer must be replaced with another one different in thickness.

In addition, the group of separators 7 may be constructed to be openable so as to be able to clean its interior by dividing each of the single separators 14 into two parts beforehand. In this case, however, note that both ends of the group of separators 7 are not fixed fast on both cylinders 5, 6, but they must be simply fitted respectively therein.

Figure 4A:
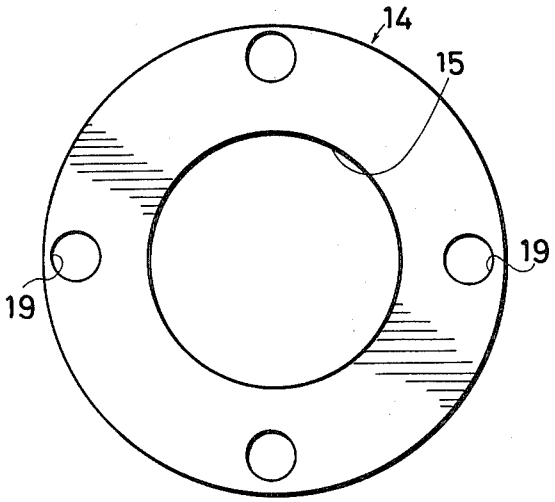
FIG. 4A is an elevational view of another embodiment of the separator according to the present invention.
Figure 4B:
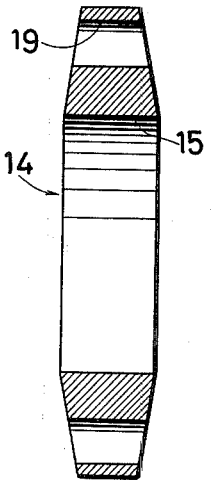
FIG. 4B is a sectional view of the embodiment shown in FIG. 4A.

Further, as shown in FIG. 4, the single separator 14 may be constructed in the form of a tapered ring becoming progressively thicker from the outer radial part toward the inner radial part. In this case, the resisting force to wear owing the chips A is strong at the start, but it soon begins to become weaker little by little.

What is more, each single separator 14 may be made in the form of a U-shape of which the upper opening is provided with a lid. In this case, this type has an advantage that the cleaning operation of the interior of the group of separators 7 can be conducted easily and simply if the lid is opened.

As clearly understood from the above description, the chips-deoiling machine according to the present invention is such a one that has the ability of separating cutting oil contained in chips while continuously conveying the chips in the transverse direction with the rotation of the screw shaft 4. Consequently, unlike conventional ones employing certrifugal separators, it can do away with a process of throwing chips into a wire-netting basket from above. Further, since the chips strike the inner circumferential surface of the central hole 15 of the thick part of each separator 14, the separator 14 is made thus of material resistant to wear, so that it does not need to be so often replaced as conventional basket. On the other hand, even in the case where chips to be treated are different in cutting size, it is possible for our machine to regulate the distance between the neighboring separators 14 by a very simple operation merely to adjust the connecting nut 21 and the fitting nut 11, so that our machine has many advantages in that it can save time and trouble unlike conventional apparatus requiring one to replace baskets different in mesh on each occasion, that there is no fear of being subjected to economical burdens to prepare various kinds of baskets, and so on. What is more, our machine is able to efficiently separate cutting oil even with slow rotation by narrowing the pitch between the screw threads of the screw shaft 4. From this, it follows that the controlling of the amount of treatment and deoiling can be attained with freedom in cooperation with the change in the number of revolutions. To crown it all, as compared with conventional centrifugal separator-types, it is simple in construction and consiquently low in production cost and further of low power consumption, which all leads to the elevation in the efficiency of deoiling.

What is claimed as new and desired to be secured by Letters Patent of the United States is:

1. A chips-deoiling machine comprising:

a group of separators consisting of a number of single separators, each of which separators has a central hole, said central holes defining a carrier passage, a boss part formed at the radially outer peripheral region of said central hole and a circumferential part which is axially thinner than said boss part and is formed at the radially outer peripheral region of said boss part;

axially adjustable means for connecting said separators;

means for moving chips through said carrier passage;

means for receiving oil passing between said separators; and a number of identical springs interposed respectively between said thin circumferential parts of said separators in order that all of said separators controllably spaced at equal intervals in relation to the separators adjacent thereto; whereby the cutting oil contained in said chips is separated through the respective gaps between said separators in the process of said chips passing from one end of the interior of said group of separators toward the other end.

* * * * *